US006526785B1

(12) United States Patent
Asenstorfer et al.

(10) Patent No.: US 6,526,785 B1
(45) Date of Patent: Mar. 4, 2003

(54) ANTI-THEFT DEVICE

(75) Inventors: Ludwig Asenstorfer, Penzberg (DE); Markus Fischer, Achmühle (DE)

(73) Assignee: AFC Technik mit Design GmbH, Penzberg (DE)

( * ) Notice: Subject to any disclaimer, the term of this patent is extended or adjusted under 35 U.S.C. 154(b) by 0 days.

(21) Appl. No.: 09/601,948

(22) PCT Filed: Feb. 23, 1999

(86) PCT No.: PCT/EP99/01178

§ 371 (c)(1),
(2), (4) Date: Aug. 9, 2000

(87) PCT Pub. No.: WO99/43916

PCT Pub. Date: Sep. 2, 1999

(30) Foreign Application Priority Data

Feb. 25, 1998 (DE) ..... 298 03 085 U

(51) Int. Cl.[7] ..... E05B 67/06
(52) U.S. Cl. ..... 70/49; 70/18; 70/30; 70/53
(58) Field of Search ..... 70/53, 18, 30, 70/49, 58

(56) References Cited

U.S. PATENT DOCUMENTS

| | | | | | |
|---|---|---|---|---|---|
| 351,063 | A | * | 10/1886 | McCormick | 70/65 |
| 539,650 | A | * | 5/1895 | Searle | 70/16 |
| 1,380,719 | A | * | 6/1921 | Johnson | 70/49 |
| 1,475,256 | A | * | 11/1923 | Belair | 70/18 |
| 1,486,037 | A | * | 3/1924 | Rousseau | 70/437 |
| 1,512,589 | A | * | 10/1924 | Freysinger | 70/39 |
| 1,530,177 | A | * | 3/1925 | Heyer | 70/39 |
| 2,190,661 | A | | 2/1940 | Hauer | |
| 2,574,967 | A | | 11/1951 | Gossner | |
| 3,906,758 | A | * | 9/1975 | Hurwitt | 70/30 |
| 4,543,806 | A | | 10/1985 | Papandrea et al. | |
| 5,473,917 | A | | 12/1995 | Say | |
| 5,791,170 | A | * | 8/1998 | Officer | 70/49 |

FOREIGN PATENT DOCUMENTS

| | | |
|---|---|---|
| AU | 587718 | 8/1989 |
| DE | 3543201 | 6/1987 |
| NL | 7612111 | 5/1978 |
| WO | 9531625 | 11/1995 |

* cited by examiner

*Primary Examiner*—Anthony Knight
*Assistant Examiner*—John B. Walsh
(74) *Attorney, Agent, or Firm*—Volpe and Koenig, P.C.

(57) ABSTRACT

The invention relates to an anti-theft device, especially for skis, comprised of a cable (3), a cable drum (2) specially connected to an end of the cable (11) in a fixed manner and a locking device (4) which contains at least one clamping element (12, 13) is provided for fixing the cable (3) which is inserted into the locking device (4). In addition, the clamping element interacts with the lock (8) in such a way that the clamping element (12, 13) releases the cable (3) when the lock (8) is opened and prevents the cable from being pulled out in a direction contrary to the direction of insertion when the lock is closed (8). The clamping (12, 13) is mounted such that it can rotate and be moved in the locking device (4). The clamping element interacts with the lock (8) via a pivoted lever (22, 23).

20 Claims, 4 Drawing Sheets

1b)

1a)

2b)

2a)

ANTI-THEFT DEVICE

BACKGROUND

Figure 1:
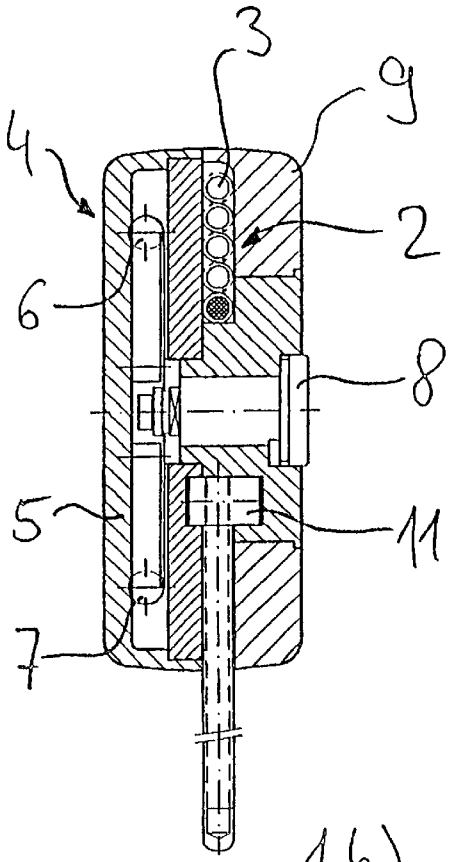
Figure 1:
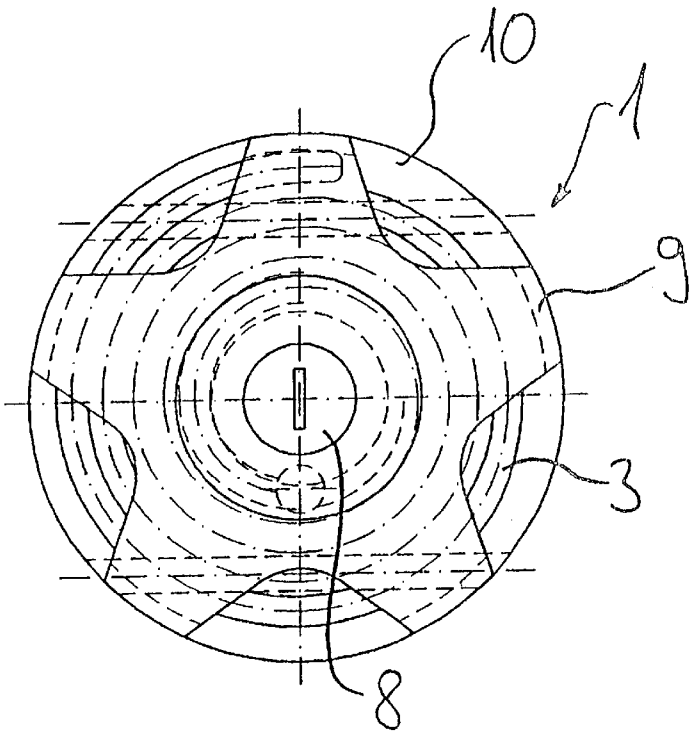

This invention pertains to an anti-theft device, in particular for skis. It comprises a cable, in particular with one end of the cable securely connected to a cable drum, and a locking mechanism that has at least one clamping member and one lock. The purpose of the clamping member is to secure the cable that is inserted into the locking mechanism. It cooperates with the lock in such a way that the clamping member releases the cable when the lock is opened and when the lock is closed, it secures it against removal in the direction opposite to the direction of insertion.

A wide variety of designs for these types of anti-theft devices are already well known (see for example WO 95/31625) that are characterized by different advantages, each of which also has its corresponding disadvantages, however. They are used especially for the fastening of skis, luggage, bicycles and similar easily stolen objects. For example, a well known cable lock of the type mentioned above has a tilting clamping member that presses against the cable at an angle such that the desired clamp effect is obtained only when the cable is inserted in a prescribed direction. The other end of the clamping member opposite the cable acts directly on the lock so that the forces transferred to the clamping member when someone tries to remove the cable is directly transferred onto the lock. This can lead to warpage in the lock area and even to loss of function of the lock.

SUMMARY

With this in mind, the object of this invention is to improve an anti-theft device of the type mentioned above to the extent that the disadvantages described are prevented or that a simple and more easily operated anti-theft device results overall.

This object is met through the invention in that the clamping member is mounted in the locking mechanism such that it rotates and shifts, and cooperates with the lock by means of a pivoting lever, and that the lock is coupled to the clamping member via the pivoting lever with respect to the rotating motion of the clamping member. Whereas in the described state of the art, the clamping member merely tilts between an open and a closed position and is acted upon by both the cable and by the lock in the closed position, the anti-theft device according to the invention has a functional separation of the two. This is accomplished in that the lock acts on the pivoting lever, which in turn is connected to the clamping member such that when an attempt is made to pull out the cable from the locking mechanism, the clamping member only acts upon the pivoting lever in the direction of the pivoting lever axis. This prevents the force from being translated into a pivoting motion that would transfer the force onto the lock because of the lack of any transverse components. In this way, it can be ensured that the function of the lock is not compromised by manipulation at the cable.

By mounting the clamping member in a rotatable fashion, and because its rotation does not cause the pivoting lever to rotate as well, the locking mechanism functions in both insertion directions. Thus, the cable can be inserted in the locking mechanism from either side. It can also be secured with the help of the clamping member, which further improves the ease of use of the anti-theft device. This two-way utility is supported further in that the clamping member includes a rounded off cam that has no edges directed at the cable when it is inserted.

It is particularly advantageous for the locking mechanism to have two rotatable and shiftable clamping members mounted within it, used to fasten two cable sections. These members cooperate with the lock through separate pivoting levers. This enables the locking mechanism to form two cable loops in the cable, making movable objects more secure against theft. This is because the first loop can be laid around the object to be secured and thus be stretched tight enough that the object cannot be pulled out of the loop, while the second loop can be laid around a stationary component—such as a ski stand, a sign or lamp post or something similar. If someone were to try and to wrap the object to be secured as well as the stationary component inside a single loop, the risk would be very high that there would possibly still be enough play to remove the objects to be secured from the loop. Of course, this especially applies to skis, which have no openings that the cable can pass through.

In this regard, it is also recommendable that the pivoting lever, or each pivoting lever, cooperate with the lock by means of a positioning element connected to the lock, mounted in the locking mechanism and which is rotatable. This further improves the decoupling of force between the clamping member and the lock. It would be advantageous to combine this positioning element with both pivoting levers, in particular on opposite sides of the positioning element so that both clamping members can be secured and blocked using a single closing motion.

With respect to the pivoting lever, it rotates within the locking mechanism between a first rotation position in which the positioning element acts upon a first side of the pivoting lever, keeping it from rotation, and a second rotating position in which the positioning element acts upon a second side of the pivoting lever, keeping it from rotating. This enables the decoupling of force mentioned above to be ensured in that the positioning element contacts the pivoting lever perpendicular to the direction that the force can be transferred from the clamping member to the pivoting lever when someone tries to remove the cable, especially in the closed lock position. In this way, the positioning element can remain absolutely free of the force components generated.

To rotate the positioning element, a key inserted into the lock is turned. This key can be removed from the lock in the closed position in order to prevent unwanted operation of the lock. The positioning element in the first rotational position of the pivoting lever corresponds to the closed position of the lock, whereas the second rotational position corresponds to the opened position of the lock.

With respect to the clamping member, it is held in a guide provided in the locking mechanism and can be rotated using a hinge pin or a similar attachment, wherein the guide runs approximately perpendicular with respect to the cable when it is inserted in the locking mechanism and toward it so that the clamping member can be shifted, by means of the hinge pin and guide, between a position away from the cable and a position pressing against the cable, perpendicular to the direction in which the cable extends. This allows the clamping member to be lifted off in the open position of the lock. To this end, the guide is designed as a slot that holds the hinge pin located in the housing of the locking mechanism.

Moreover, it is recommended that the clamping member, i.e. each clamping member, be tensioned toward the inserted cable, in particular through the force of a spring, which keeps the clamping member in its initial, non-tilted position.

With respect to the cooperation between clamping member and pivoting lever, it is recommended that these two components be connected using a rotatably fastened coupling element, wherein, again, the connection of clamping member and coupling element is done through the hinge pin mentioned above. Also, the pivot lever and the coupling element together form a pivoting joint and can be rotated in opposite directions using the common joint axis. The joint axis is located near the first side of the pivoting lever.

Moreover, it is recommended that the locking mechanism have at least one through passage to insert and pull through the cable, and that the clamping member act upon the inserted cable near the through passage. The through passage is formed by a channel that is sized approximately to fit the shape of the cable, wherein the clamping member fixes the cable against the walls of the channel without play when the lock is shut and the cable is inserted. In order to make removal of the cable more difficult or to prevent it, the channel should be given a profile that acts upon the cable, in particular with a right-handed and left-handed thread.

Also, the fastening of the cable is improved even more if the clamping member is forwarded from a cam that is provided with a profile where it acts upon the cable, in particular with a tooth profile.

An important advantage of the anti-theft device of the type mentioned above is accomplished in that the cable drum has a housing to keep the cable in its interior, that the lateral length of the housing interior is approximately equal to the cable diameter so that the safekeeping of the cable is accomplished by a single-row spiral in the interior. Neighboring cable windings lie against one another in the radial direction. The fact that, for a long time, previous cable locks were unwieldy because the cable had become entangled inside the housing interior is the reason for this design feature. Because of the spring force associated with the cable, every cable winding tends to press against the outer walls. If the width of the housing interior is such that a number of cable windings can be located next to one another in the lateral direction, this entanglement and blocking of the cable in the housing interior is inevitable. This type of entanglement is thus prevented by means of the invention in that the cable is wound in only a single-row.

It is also particularly advantageous in this regard if the housing has not only one, but a number of openings located at least in the radial direction at the outer walls of the housing. The cable can be unwound through them from the interior of the housing. Through this multitude of openings, which should be dimensioned sufficiently large, the end of the cable can be placed in the housing without there being a problem in retrieving it due to the end of the cable not being near the opening in the housing, such that the end of the cable becomes irretrievably lost in the housing. In this way, the end of the cable can be moved in a simple manner to the next opening by moving the housing relative to the end of the cable, whereupon the cable end springs out through the opening by means of a reacting spring force. The cable drum is fastened to the locking mechanism and the housing of the cable drum can be rotated with respect to the locking mechanism so that the rotation mentioned can be made in a simple manner by a short relative motion between the housing and the locking mechanism.

Finally, it is recommended that the lock extend in the direction of the rotating axis and to be rotationally fixed to the locking mechanism, and that the direction of insertion of the key correspond to the rotating axis, i.e. be parallel to it. In this way, the lock constitutes the rotating joint for the housing simultaneously, which results in an optimization with respect to assembly. The results in a very easy-to-use cable lock with a single-row spiral cable winding, which allows the end of the cable to be stored in the wound state in the housing. The exterior dimension of the cable lock then can be further reduced.

BRIEF DESCRIPTIONS OF THE DRAWINGS

Figure 2:
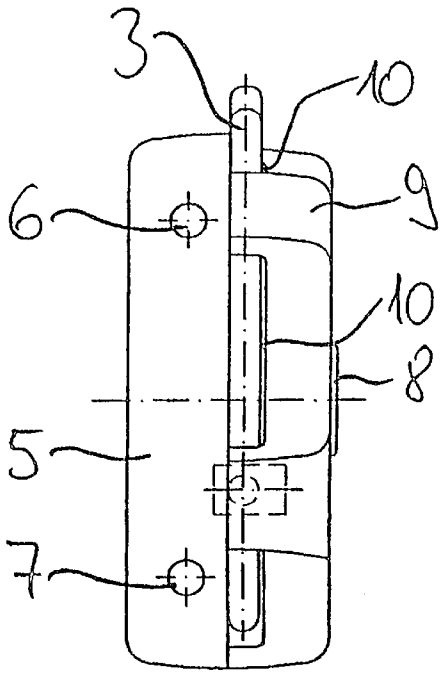
Figure 2:
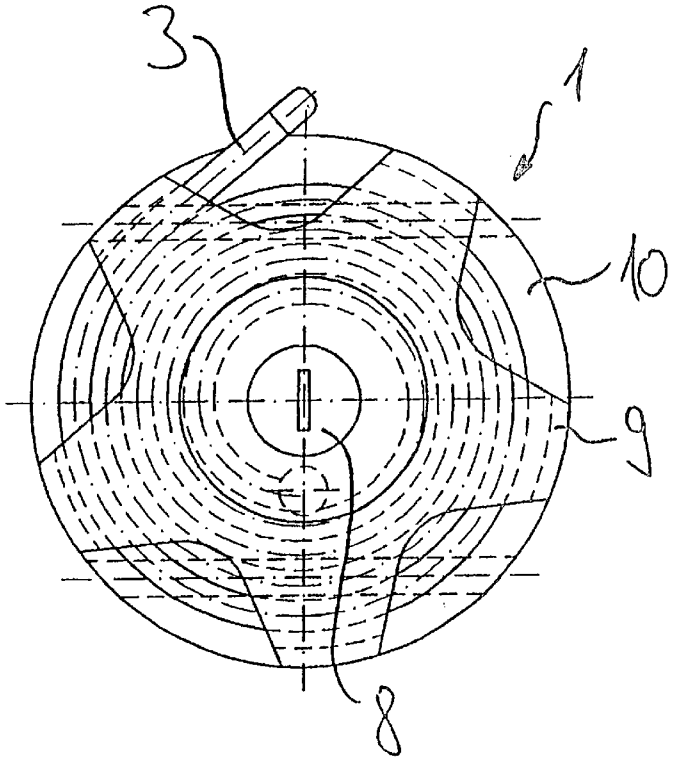

Other features and advantages of this invention are found in the following description of a preferred embodiment shown in the drawings. Shown are FIG. 1 an anti-theft system according to the invention in the form of a cable lock as seen from the top and in a sectional side view;

FIG. 2 the cable lock of FIG. 1 with protruding cable end as seen from the top as well as from a side view; and FIGS. 3 through 6 interior views of a locking mechanism of the cable lock according to the invention in various positions.

DETAILED DESCRIPTION OF THE PREFERRED EMBODIMENTS

FIG. 1 shows an anti-theft device in the form of a cable lock 1 having a cable drum 2 with a cable wound onto it in a single-row spiral, and a locking mechanism 4. The locking mechanism 4 includes a housing 5 having two through passages 6,7 through which the cable is inserted, and a lock 8, which cooperates with the locking mechanism in the manner shown in FIGS. 3 through 6.

The lock 8 forms the rotatable connection for a housing 9 surrounding the cable drum 2, which has a star-shaped contour as seen from above with five housing openings 10 through which the cable can be removed outward as shown in FIG. 2.

The inside end 11 of the cable 3 is held solidly and securely in the cable drum and keeps the cable from unwinding and at the same time forms the first point of a loop, while the two other points are formed by the two clamping members described below in more detail.

Figure 3:
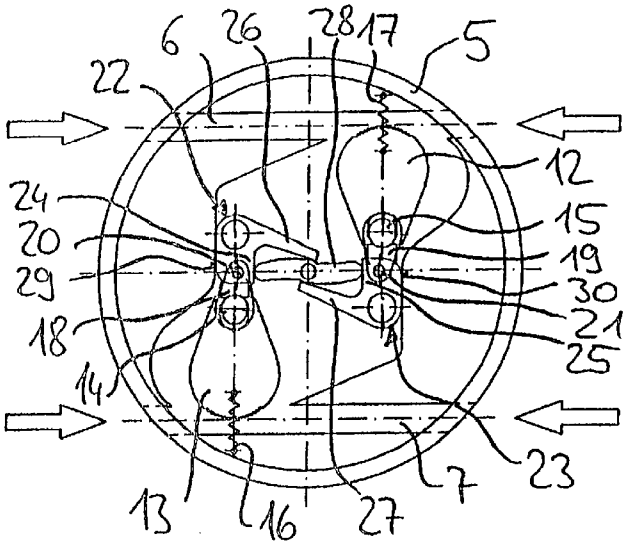
Figure 4:
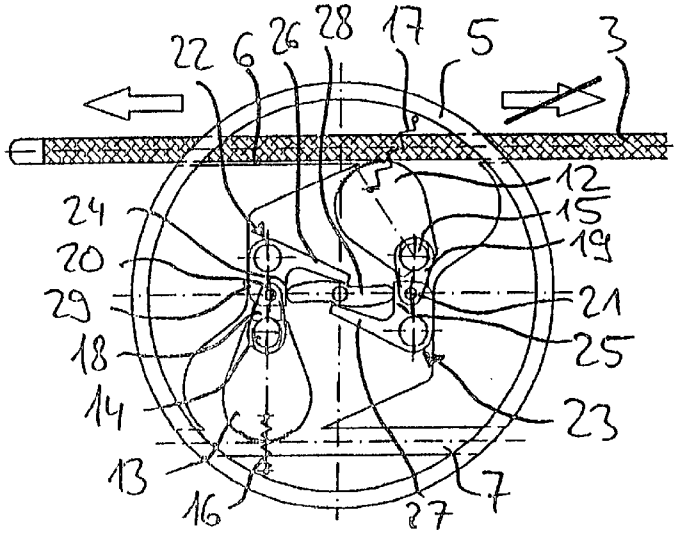
Figure 5:
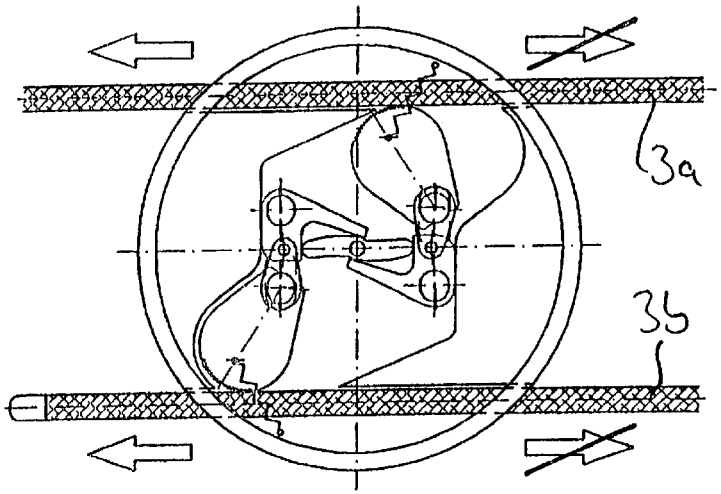
Figure 6:
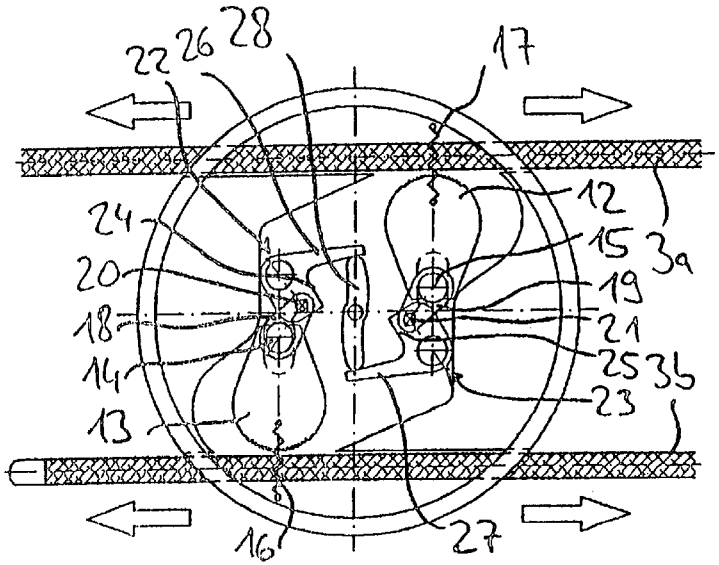

In FIG. 3—just as in the FIGS. 4 through 6—the locking mechanism 4 is shown seen from above, namely the housing 5 and the two through passages 6 and 7 as well as the two cam-shaped clamping members 12, 13 which are mounted to the housing opposite to one another and can be rotated and shifted laterally. The lateral shift is done through a hinge pin 14, 15, which is held in a slot provided in the housing (not clearly shown in the figures). This slot extends perpendicular to the direction that the inserted cable extends. The clamping members 12, 13 are held by return springs 16, 17 in their un-tilted initial positions in which they protrude into the channel formed by the through passages 6, 7. When the cable 3 is inserted into this channel—as seen in FIG. 4—it acts upon the clamping members and tilts them to the side in the direction of insertion.

The clamping members 12, 13 are each connected to a coupling element 18, 19 through their hinge pins 14, 15. This coupling element is fastened through a pivoting joint 20, 21 to a pivoting lever 22, 23. Each coupling element forms, together with the associated pivoting lever, a toggle joint which can be seen to function as in FIG. 6 in particular. Here, the open position of the locking mechanism is shown in which the position of the elbow joint is tilted inward.

Each pivoting lever 22, 23 has two sides, namely a first side 24 and 25, in which the joint 20, 21 of the toggle joint is located, and a second side 26, 27 which is at approximately a 70° angle with respect to the first side.

Both pivoting levers 22, 23 cooperate with a positioning element 28 which is coupled to the lock 8 and which transfers the rotational motion of a key inserted into the lock to the pivoting levers.

The way in which the locking mechanism functions is now as follows: in FIG. 3, the locking mechanism is shown without the cable section inserted, wherein the positioning element is in its level closed position, touching the first side 24, 25 of the two pivoting levers and thus fixing the pivoting levers in conjunction with a shoulder 29, 30 located at the opposite side of the housing. The toggle joint formed by the pivoting lever and coupling element is stretched into the positions shown in FIGS. 3 through 5 so that its respective clamping member is located at the end of its lateral shift in the position at which it extends into the through passage, i.e. into the associated channel.

If now, as in FIG. 4, a cable is inserted, it collides with the clamping member and tilts it about the hinge pin 14, 15 in the direction of insertion, i.e. from right to left here. In this way, the clamping member does not block the cable from being passed further through thanks to its lateral flexibility; however, if it is pulled against the direction of insertion, the clamping member is tilted backward by the cable due to the friction and form lock engagement produced by its exterior teeth. This decreases the distance between the channel walls and the clamping member at the same time due to the tilt movement, and the cable is then secured as indicated in FIG. 4 by the struck-through arrow to the right.

In FIG. 5, the locking mechanism is shown with two inserted cable sections 3*a*, 3*b* wherein these two cable sections, together with the end of the cable 11, form two loops through which, first of all, a movable object can be fixed to the locking mechanism and, secondly, the locking mechanism can be attached to a stationary component—such as a ski-carrier.

In the position shown in FIG. 5, the cable section 3*a*, 3*b* can only be moved further along the direction of insertion to the left, but due to the self-securing function described above of the clamping member, can not be pulled out of the locking mechanism again against the direction of insertion, i.e. to the right.

Only in the position shown in FIG. 6, in which the positioning element has been rotated by 90°, are the associated clamping members shifted laterally by means of the pivoting lever and the coupling element, and away from the associated cable sections, enabling the engagement with the cable section to be removed and the cable sections to be pulled out of the locking mechanism opposite to the direction of insertion.

In this position, the lateral shift of the clamping members is produced by the folding together of the toggle joint, whereupon the distance between the associated hinge pin and the tilt axis of the pivoting lever is shortened. Due to the lever effect, even the smallest force is sufficient to activate the positioning lever, i.e. when the key is turned, to remove the connection between the clamping member and the cable, even if prior to opening the lock an attempt was made to remove the cable from the locking mechanism without the key by pulling on the cable, which—as described above—only increases the compression of the clamping member onto the cable. In known cable locks, this motion causes force to be transferred to the lock until it warps.

In summary, this invention offers the advantage that, for one thing, a coupling of force between the lock and clamping member is produced which allows the anti-theft device to function unaffected by any forces acting on the cable. Additionally, the single-row winding of the cable onto the cable drum prevents blocking during winding of the cable, which also considerably improves the functioning of the anti-theft device.

What is claimed is:

1. An anti-theft device for skis, comprising a cable (3, 3*a*, 3*b*), a cable drum (2) connected to one end of the cable and a locking mechanism (4) that has at least one clamping member (12, 13) and a lock (8) as well as a through passage (6, 7) for insertion and passing through the cable (3, 3*a*, 3*b*), wherein the at least one clamping member secures a portion of the cable inserted in the through passage of the locking mechanism and cooperates with the lock such that the at least one clamping member releases the cable when the lock is opened and secures it against removal in the direction opposite to the insertion when the lock is closed, characterized in that the at least one clamping member (12, 13) rotates and shifts in the closed direction (4) and cooperates with the lock (8) by means of a pivoting lever (22, 23), and that the lock is uncoupled from the at least one clamping member via the pivoting lever with respect to the rotating motion of the at least one clamping member, and the pivoting lever cooperates with the lock (8) through a positioning member (28) mounted to and rotatable in the locking mechanism (4) and connected to the lock.

2. An anti-theft device according to claim 1, characterized in that the locking mechanism (4) has two rotatable and shiftable clamping members (12, 13) that cooperate with the lock through separate pivoting levers (22, 23).

3. An anti-theft device according to claim 1, characterized in that the clamping member (12, 13) comprises a cam and that the cam is provided with a profile on the side that acts upon the cable (3, 3*a*, 3*b*).

4. An anti-theft device according to claim 1, characterized in that there are two pivoting levers, and each of the pivoting levers (22, 23) cooperate with the same positioning member (28) on opposite sides of the positioning member.

5. An anti-theft device according to claim 1, characterized in that the pivoting lever is mounted in and rotates in the locking mechanism (4) and that the pivoting lever rotates between a first position at which the positioning member (28) lies against a first side (24, 25) of the pivot lever and keeps it from rotating, and a second position at which the positioning member lies against a second side (26, 27) of the pivoting lever and secures it against turning.

6. An anti-theft device according to claim 1, characterized in that the turning of the positioning member (28) is done by turning a key inserted in to the lock (8).

7. An anti-theft device according to claim 5, characterized in that the first rotational position of the pivoting lever (22, 23) is associated with the closed position of the lock (8) and that the second rotational position is associated with the open position of the lock.

8. An anti-theft device according to claim 1, characterized in that the clamping member is rotatably mounted about a hinge pin (14, 15), in a guide provided in the locking mechanism (4), rotating, and that the guide runs approximately perpendicular toward the cable (3, 3*a*, 3*b*) that is inserted into the locking mechanism.

9. An anti-theft device according to claim 8, characterized in that the guide consists of a slot that holds the hinge pin (14, 15).

10. An anti-theft device according to claim 8, characterized in that a connection of clamping member (12, 13) and coupling element (18, 19) is provided by the hinge pin (14, 15).

11. An anti-theft device according to claim 1, characterized in that the clamping member is tensioned in a direction of the inserted cable (3, 3*a*, 3*b*) using the force of a spring.

12. An anti-theft device according to claim 1, characterized in that the cable drum (2) has a housing (9) to safekeep the cable (3) in its interior, that the lateral length of the housing interior corresponds approximately with the cable diameter so that the safekeeping of the cable is accomplished by winding it into a single-row spiral in the interior.

13. An anti-theft device according to claim 12, characterized in that the housing (9) has at lease one opening (10) located at least in the radial direction at the outer wall of the housing, through which the cable (3, 3*a*, 3*b*) can be unwound from the interior of the housing.

14. An anti-theft device according to claim 1, characterized in that the locking mechanism (4) has at least one through channel (6, 7) to insert and pass through the cable (3, 3*a*, 3*b*) and that the clamping member (12, 13) presses against the cable near the through channel.

15. An anti-theft device according to claim 14, characterized in that the through channel (6, 7) is approximately sized to fit the form of the cable, and that the clamping member (12, 13) fastens the cable against the walls of the channel when the lock (8) is closed and the cable (3, 3*a*, 3*b*) is inserted.

16. An anti-theft device according to claim 15, characterized in that the channel is provided with a profile designed to act upon the cable (3, 3*a*, 3*b*) using a right-handed and a left-handed threading.

17. An anti-theft device according to claim 1, characterized in that the cable drum (2) is fastened to the locking mechanism (4) and that a housing (9) of the cable drum can rotate with respect to the locking mechanism.

18. An anti-theft device according to claim 17, characterized in that the lock (8) extends in the direction of an axis of rotation and an insertion direction of a key corresponds to a direction of its axis of rotation.

19. An anti-theft device for skis, comprising a cable (3, 3*a*, 3*b*), a cable drum (2) connected to one end of the cable and a locking mechanism (4) that has at least one clamping member (12, 13) and a lock (8) as well as a through passage (6, 7) for insertion and passing through the cable (3, 3*a*, 3*b*), wherein the at least one clamping member secures a portion of the cable inserted in the through passage of the locking mechanism and cooperates with the lock such that the at least one clamping member releases the cable when the lock is opened and secures it against removal in the direction opposite to the insertion when the lock is closed, characterized in that the at least one clamping member (12, 13) rotates and shifts in the closed direction (4) and cooperates with the lock (8) by means of a pivoting lever (22, 23), and that the lock is coupled to the at least one clamping member via the pivoting lever with respect to the rotating motion of the at least one clamping member, and the clamping member and its associated pivot lever (22, 23) are connected through a coupling element (18, 19) fastened rotatably to both of these components.

20. An anti-theft device according to claim 19, characterized in that the pivoting lever (22, 23) and the coupling element (18, 19) together form an elbow joint and rotate about a common hinge axis (20, 21) in opposing directions and that the hinge axis is located near the first side (24, 25) of the pivoting lever.

* * * * *